US007278594B2

(12) United States Patent
Koyanagi et al.

(10) Patent No.: US 7,278,594 B2
(45) Date of Patent: Oct. 9, 2007

(54) FUEL INJECTOR

(75) Inventors: Kazuaki Koyanagi, Obu (JP); Hiroshi Kawazoe, Obu (JP)

(73) Assignee: Aisan Kogyo Kabushiki Kaisha, Aichi-ken (JP)

( * ) Notice: Subject to any disclaimer, the term of this patent is extended or adjusted under 35 U.S.C. 154(b) by 0 days.

(21) Appl. No.: 11/384,243

(22) Filed: Mar. 21, 2006

(65) Prior Publication Data

US 2006/0214033 A1 Sep. 28, 2006

(30) Foreign Application Priority Data

Mar. 25, 2005 (JP) ..... 2005-089025

(51) Int. Cl.
*B05B 1/30* (2006.01)

(52) U.S. Cl. ..... 239/585.1; 239/585.4; 239/585.5; 239/900; 251/129.15; 251/129.21; 335/255

(58) Field of Classification Search ..... 239/585.1, 239/585.2, 585.3, 585.4, 585.5; 335/255, 335/261, 277, 271; 251/129.15, 129.21
See application file for complete search history.

(56) References Cited

U.S. PATENT DOCUMENTS 5,732,888 A 3/1998 Maier et al.
5,996,911 A * 12/1999 Gesk et al. ..... 239/585.1
6,019,297 A 2/2000 Hall
6,024,293 A 2/2000 Hall
6,499,668 B2 * 12/2002 Dallmeyer et al. ..... 239/5

FOREIGN PATENT DOCUMENTS

JP 2003-328891 11/2003

* cited by examiner

*Primary Examiner*—Dinh Q. Nguyen
(74) *Attorney, Agent, or Firm*—Dennison, Schultz & MacDonald

(57) ABSTRACT

A fuel injector 10 may comprise a valve body 14 having a fuel path, a valve seat 23 fixed to a downstream end of the valve body, and a valve 25 that opens and closes a fuel injection hole of the valve seat 23. The valve may be housed within the valve body in a manner allowing sliding. An armature 31 may be attached to an upstream end of the valve 25, and a valve closing element 32 may be attached to a downstream end of the valve 25. A core 21 may be disposed at an upstream side of the armature 31. A downstream end surface of the core 21 faces an upstream end surface of the armature 31. When the valve 25 opens the fuel injection hole, the downstream end surface of the core 21 makes contact with the upstream end surface of the armature 31. A non-magnetic ring 20 may be disposed at an outer circumference side of the armature 31 and the core 21. The non-magnetic ring 20 may extend as far as an upstream side of the solenoid coil 18, and the solenoid coil 18 may be wound directly around an outer circumference of the non-magnetic ring 20.

2 Claims, 4 Drawing Sheets

FUEL INJECTOR

CROSS REFERENCE

This application claims priority to Japanese Patent application number 2005-89025, filed on Mar. 25, 2005, the contents of which are hereby incorporated by reference as if fully set forth herein.

BACKGROUND OF THE INVENTION

1. Field of the Invention

The present invention relates to a fuel injector. Specifically, the present invention relates to a technique for reducing the diameter of a fuel injector.

2. Background of the Invention

FIG. 8 shows a longitudinal section of a conventional fuel injector 100. The fuel injector 100 comprises a valve body 116, a core 122, a valve seat 112, a valve 110, a spring 120, and a solenoid coil 106. The valve body 116 has a fuel path. The valve seat 112 is attached to a downstream end of the valve body 116, and a fuel injection hole 112*a* is formed in the valve seat 112. The valve 110 is housed within the valve body 116, and can slide between an open position and a closed position. The valve comprises a shaft 109, an armature 108, and a ball 114. The armature 108 is attached to an upstream end of the shaft 109, and the ball 114 is attached to a downstream end of the shaft 109. The fuel injection hole 112*a* is open when the valve 110 is in the open position, and the fuel injection hole 112*a* is closed when the valve 110 is in the closed position. The spring 120 applies a biasing force on the valve 110, wherein the biasing force pushes the valve 110 in the closed position. The core 122 is disposed upstream from the armature 108. When the valve 110 is in the open position, an upstream end surface of the armature 108 makes contact with a downstream end surface of the core 122. When the valve 110 is in the closed position, the upstream end surface of the armature 108 is separated from the downstream end surface of the core 122. A non-magnetic ring 104 is disposed at an outer circumference side of the armature 108 and the core 122. The non-magnetic ring 104 extends from an upstream side of the armature 108 to a downstream side of the core 122. A downstream end of the non-magnetic ring 104 is fixed to the valve body 116, and an upstream end of the non-magnetic ring 104 is fixed to the core 122. A resin bobbin 102 is formed at an outer circumference of the non-magnetic ring 104 and the core 122, and the solenoid coil 106 is wound around the bobbin 102. An upper body 118 is disposed at an outer side of the solenoid coil 106, and a downstream end of this upper body 118 is connected with the valve body 116. An upstream end of the upper body 118 is connected with the core 122.

Pressurized fuel is supplied to the fuel injector 100 from fuel supply line (not shown). When the solenoid coil 106 is excited, a magnetic path is formed from the upper body 118, the valve body 116, the armature 108, and the core 122. At this juncture, the non-magnetic ring 104 prevents magnetic flux from short-circuiting from the valve body 116 to the core 122. When the magnetic path has been formed, the armature 108 is attracted by magnetic force, and the valve 110 retreats towards the core 122 side (towards a posterior end side) in resistance to biasing force of the spring 120. The fuel is thus injected from the fuel injection hole 112*a*. When the excitement of the solenoid coil 106 is halted, the biasing force of the spring 120 causes the valve 110 to advance towards the valve seat 112, and the injection of fuel is suspended.

SUMMARY OF THE INVENTION

As combustion control in internal combustion engines has advanced in recent years, there has been a demand for reducing the diameter of a fuel injector and for injecting fuel from a position closer to a combustion chamber. In order to reduce the diameter of the fuel injector, the diameter of the armature and the core need to be reduced. However, when the diameter of the armature and the core are reduced, the valve attracting force decreases, and the responsiveness of the valve decreases.

Japanese Laid-open Patent Publication No. 2002-509218 discloses technology to reduce the diameter of the fuel injector without a decrease of responsiveness of the valve. In this fuel injector, a solenoid coil is disposed without there being a bobbin formed at an outer circumference of a non-magnetic ring. With this fuel injector, the solenoid coil is disposed closer to the armature and the core, and consequently attracting force of the valve increases, and a decrease in the responsiveness of the valve can be suppressed.

However, in this fuel injector, the solenoid coil is longer than the non-magnetic ring in the axial direction. As a result, it is not possible to use normal methods to weld the non-magnetic ring and the core together in a state where the solenoid coil has been mounted on the non-magnetic ring. Therefore, a slot (a notch) is formed in a part of an upstream end of the solenoid coil, and the non-magnetic ring and the core are welded in this slot part while the solenoid coil rotates around the non-magnetic ring. As a result, an inner surface of the solenoid coil must be made to be a smooth so that the solenoid coil can rotate around the non-magnetic ring, and a generous clearance is required between the inner surface of the solenoid coil and the non-magnetic ring. This hinders a reduction in the diameter of the fuel injector. Furthermore, there is the problem that the welding operation requires accuracy, and that the welding operation becomes more complex.

It is, accordingly, one object of the present teachings to provide a fuel injector which allows the diameter of a fuel injector to be reduced by means of disposing a solenoid coil without there being a bobbin formed at an outer circumference of a non-magnetic ring, and in which the non-magnetic ring and a core can be welded together simply.

In one aspect of the present teachings, a fuel injector may comprise a valve body having a fuel path, and an armature slidably disposed within the valve body. A core is disposed at an upstream side of the armature, and a non-magnetic ring is disposed at an outer circumference side of the armature and the core. The non-magnetic ring extends from an upstream end of the valve body to a downstream end side of the core. The fuel injector further includes a solenoid coil that attracts the armature toward the core. The non-magnetic ring preferably extends as far as an upstream side of the solenoid coil, and the solenoid coil is wound directly around an outer circumference of the non-magnetic ring.

With this fuel injector, the non-magnetic ring extends as far as the upstream side of the solenoid coil. As a result, even when the non-magnetic ring and the core are welded together after the solenoid coil has been wound around the non-magnetic ring, the non-magnetic ring and the core can be welded at the part not covered by the solenoid coil. The operation of welding the non-magnetic ring and the core can thus be performed simply.

Further, the operation of welding the non-magnetic ring and the core may be performed after the solenoid coil has been wound around the non-magnetic ring, or before the solenoid coil has been wound around the non-magnetic ring.

In this fuel injector, it is preferred that outer diameter of the core is approximately the same as the diameter of the non-magnetic ring. With this type of configuration, even when the solenoid coil is mounted on the non-magnetic ring after the non-magnetic ring and the core have been welded, the solenoid coil that has been wound can be inserted from an upstream side of the core in an axial direction, and the solenoid coil can be attached to the outer circumference of the non-magnetic ring. It is thus possible to improve the ease of assembly of the solenoid coil.

Further, it is preferred that an insulating coating is formed on a coil winding portion of the non-magnetic ring. If an insulating coating is formed on the coil winding portion of the non-magnetic ring, insulating film on coil wire of the solenoid coil can be protected.

Moreover, a collar may be formed at a downstream end of the non-magnetic ring. In this case, it is preferred that the collar of the non-magnetic ring makes contact with an upstream end surface of the valve body, and that the two are welded. Furthermore, it is preferred that the position at which the collar and the upstream end surface of the valve body are welded forms a loop along the collar. With this type of configuration, the non-magnetic ring and the body are joined firmly, and fuel can be prevented from leaking from joining surfaces thereof.

Further, it is preferred that the downstream end of the core is inserted into an inner circumference side of the non-magnetic ring, and that the two are welded. Furthermore, it is preferred that the position at which the non-magnetic ring and the core are welded forms a loop along the outer circumference of the non-magnetic ring. With this type of configuration, the non-magnetic ring and the core can be joined firmly, and fuel can be prevented from leaking from joining surfaces thereof.

In another aspect of the present teachings, fuel injector is taught that are capable of increasing responsiveness when the valve is to close. That is, when the valve is to close, an upstream end surface of the armature and a downstream end surface of the core make contact in a state where these surfaces are wet by fuel. In this condition, when the valve is to close, i.e. when the upstream end surface of the armature and the downstream end surface of the core are to be separated, a resisting force (hereinafter referred to as a kind of "adhesive force") is generated, since the velocity of the fuel flowing into the gap between the armature and the core is limited. There is consequently a decrease in the responsiveness for closing the valve. In order to prevent there being a decrease in the responsiveness for closing the valve due to this adhesive force, Japanese Laid-Open Patent Publication Nos. 9-310650 and 2003-328891 disclose technology to mechanically form protrusions and recesses at the upstream end surface of the armature.

However, when the diameter of the fuel injector is to be reduced, the diameter of the armature and the core need to be reduced, and there is the major problem that the attracting force consequently decreases. For this reason, it is preferred that the distance between the armature and the core is decreased when the valve is closing the fuel injection hole of the valve seat, and that the magnetic force of the solenoid coil is increased as much as possible when the solenoid coil is excited. However, when the protrusions and recesses has been formed mechanically on the upstream end surface of the armature, there is a greater distance between the core and a bottom portion of a recesses on the armature than in the case where the upstream end surface of the armature is a flat surface. This causes a decrease in the magnetic force of the solenoid coil when the solenoid coil is excited, and decreases responsiveness when the valve is to be opened. As a result, the mechanical protrusions and recesses formed on the upstream end surface of the armature are not preferred.

Therefore, in another aspect of the present teachings, a fuel injector may comprise a core and a valve disposed at a downstream side of the core. The valve may include an armature on one end of the valve and a hole closing element on the other end of the valve. The fuel injector may further comprise a solenoid coil that attracts the valve toward the core. When the solenoid coil is excited, magnetic force thereof causes an upstream end surface of the armature to make contact with a downstream end surface of the core. When the solenoid coil is not excited, the hole closing element closes a fuel injection hole of a valve seat.

In this fuel injector, at least one of the upstream end surface of the armature and the downstream end surface of the core is plated. The thickness of the plating layer varies in a radial direction. The upstream end surface of the armature and the downstream end surface of the core are made to be approximately parallel without the plating layer. As a result, the upstream end surface of the armature and the downstream end surface of the core make contact at one part in the radial direction (i.e. the part where the thickness of the plating layer is greater). The upstream end surface of the armature and the downstream end surface of the core thus do not make contact over their entire faces, and the adhesive force between the armature and the core can therefore be reduced.

Furthermore, the upstream end surface of the armature and the downstream end surface of the core are made to be approximately parallel before the plating is performed, and the plating layer can be made thinner. As a result, the distance between the armature and the core can be reduced when the valve is in a closed state, and a reduction in the magnetic attracting force can therefore be suppressed. Consequently, with this fuel injector, it is possible to reduce the adhesive force without reducing the magnetic attracting force.

In this fuel injector, it is preferred that the plating layer is thicker at the inner circumference side. With this type of configuration, the upstream end surface of the armature and the downstream end surface of the core make contact at the inner circumference side. The area of contacting portions of the two is thus reduced, and consequently the adhesive force between the two can effectively be reduced.

These aspects and features may be utilized singularly or, in combination, in order to make improved fuel injector. In addition, other objects, features and advantages of the present teachings will be readily understood after reading the following detailed description together with the accompanying drawings and claims. Of course, the additional features and aspects disclosed herein also may be utilized singularly or, in combination with the above-described aspect and features.

DETAILED DESCRIPTION OF THE INVENTION

Figure 1:
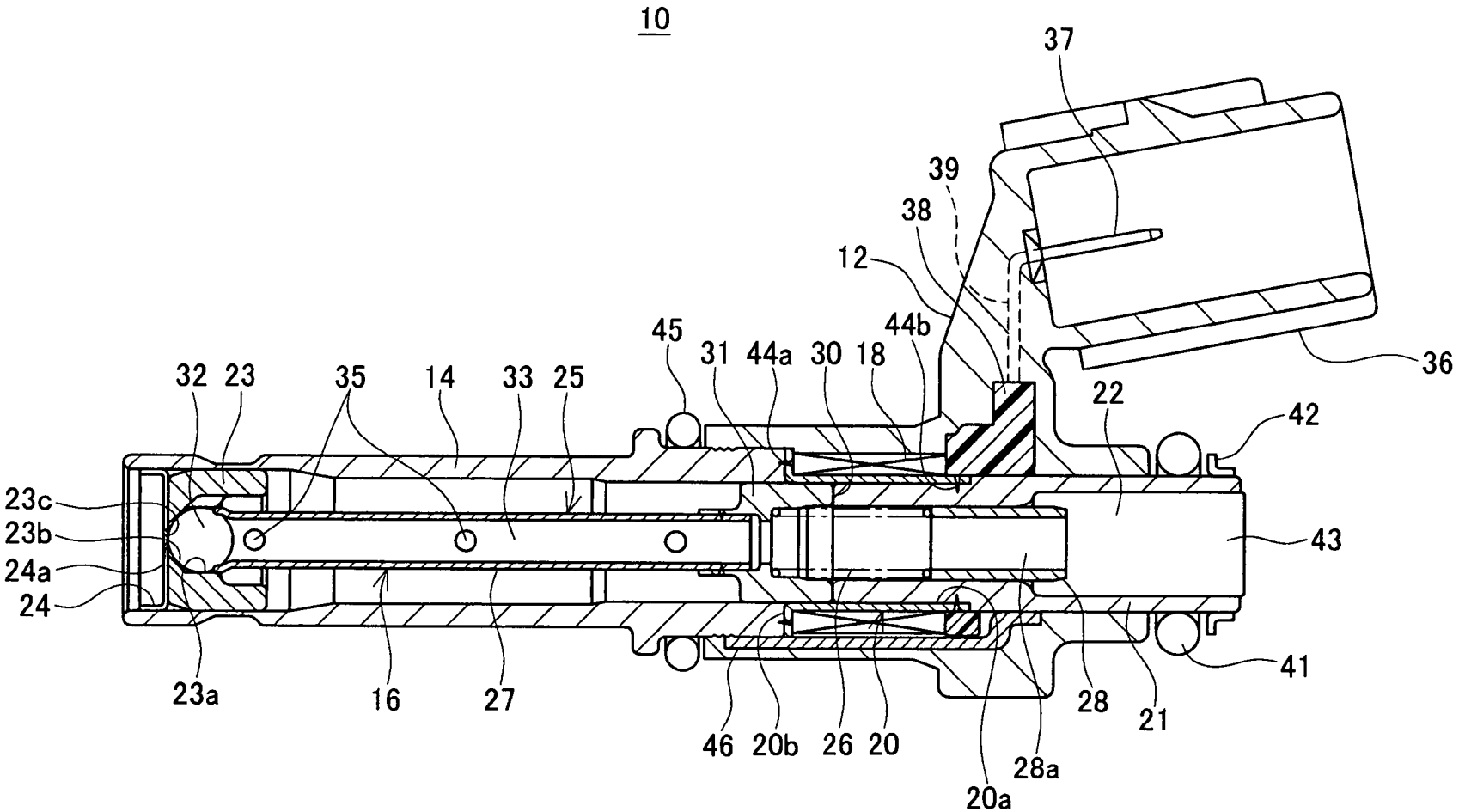
FIG. 1 is a vertical cross-section drawing of a fuel injector of a representative embodiment of the present teachings.

A fuel injector 10 of a representative embodiment of the present teachings will be described with reference to figures. As shown in FIG. 1, fuel injector 10 comprises a housing 12, a valve body 14, a core 21, a ring 20, a valve mechanism 16, and a solenoid coil 18.

The core 21 is formed in a tubular shape and is fixed within the housing 12. The core 21 passes through the housing 12, and the core 21 has a fuel path 22 which passes through in the axial direction. The core 21 is made from a magnetic material (e.g., magnetic stainless steel).

The ring 20 is fixed to an anterior end of the core 21. The ring 20 has a cylindrical main body 20*a*, and a collar 20*b* formed at an anterior end of the main body 20*a*. The anterior end of the core 21 is inserted into the ring 20, and an anterior end surface of the core 21 reaches until part-way along the main body 20*a*. An outer circumference surface of the ring 20 and an outer circumference surface of a posterior end of the core 21 form approximately level surfaces when the anterior end of the core 21 has been inserted into the ring 20. That is, the outer diameter of the ring 20 and the outer diameter of the posterior end of the core 21 are approximately level.

The ring 20 and the core 21 are fixed by means of a welded part 44*b*. The welded part 44*b* is located upstream from a portion where the solenoid coil 18 is wound. The welded part 44*b* forms a loop around the outer circumference of the ring 20. Fuel is thus prevented from leaking out between the core 21 and the ring 20 (i.e. the fuel is sealed). Furthermore, the ring 20 is made from a non-magnetic material (e.g., non-magnetic stainless steel). An insulating coating is formed on a surface of the ring 20. Polyimide varnish, fluororesin, etc. can be used as the insulating coating. It is preferred that the thickness of the insulating coating is approximately 10 μm.

The collar 20*b* of the ring 20 makes contact with a posterior end surface of the valve body 14, and is fixed to the valve body 14 by a welded part 44*a*. The welded part 44*a* forms a loop in a circumference direction on the collar 20*b*. Fuel is thus prevented from leaking out between the ring 20 and the valve body 14 (i.e. the fuel is sealed). The valve body 14 is formed in a tubular shape from a magnetic material (e.g., electromagnetic stainless steel).

A valve seat 23 is inserted and fixed in an anterior end of the valve body 14. The valve seat 23 has a cylindrical slide hole 23*a*, a bowl-shaped part 23*b* communicating with the sliding hole 23*a*, and an opening hole 23*c* which is opened in the bottom of the bowl-shaped part 23*b*. A disc-shaped plate 24 is fixed to an anterior end side of the valve seat 23. A fuel injection hole 24*a* is formed in the center region of the plate 24 in a position which overlaps the opening hole 23*c* of the valve seat 23.

The valve mechanism 16 comprises a valve 25, a spring 26, and an adjustor 28. The valve 25 comprises a hollow shaft 27, an armature 31 attached to a posterior end side of the shaft 27, and a ball 32 attached to an anterior end of the shaft 27. A fuel path 33 that extends in the axial direction is formed within the armature 31 and the shaft 27. The fuel path 33 is closed on an anterior end side by the ball 32, and a posterior end side thereof is open and communicates with the exterior. A hole 35 which communicates with the fuel path 33 and the exterior is formed in the shaft 27. The armature 31 is formed from a magnetic material (e.g., electromagnetic stainless steel).

Figure 2:
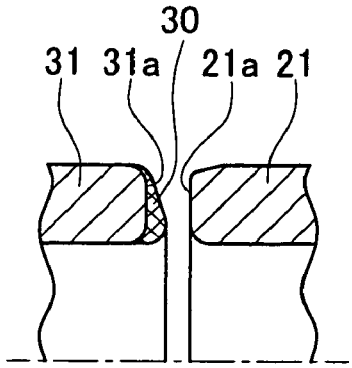
FIG. 2 is an enlarged view of contacting parts of an armature and a core.
Figure 3:
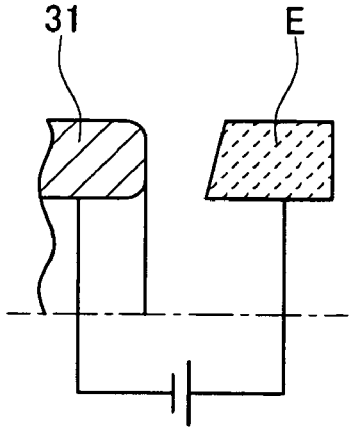
FIG. 3 is a drawing for explaining a method of forming a plating layer on a posterior end surface of the armature.

As shown clearly in FIG. 2, a plating layer 30 is formed on a posterior end surface 31*a* of the armature 31. The plating layer 30 is thicker at an inner circumference side of the armature 31, and grows thinner towards the outer circumference side thereof (i.e. the thickness of the plating layer 30 changes along the radial direction of the armature 31). This change in the thickness of the plating layer 30 in the radial direction can be achieved by using, for example, an electrode E as shown in FIG. 3. That is, distance is less between the electrode E and the posterior end surface 31*a* at the inner circumference side, and is greater at the outer circumference side. By performing electrolytic plating using this type of electrode E, the plating layer 30 can be made thicker at the inner circumference side of the posterior end surface 31*a*, and can be made thinner at the outer circumference side thereof. Hard chrome plating, for example, can be used as the plating layer 30. Further, it is preferred that the thickness of the plating layer 30 is 10~15 μm.

The posterior end surface 31*a* of the armature 31 (i.e., the surface before the plating is performed) faces an anterior end surface 21*a* of the core 21 in an approximately parallel manner. As a result, when the posterior end of the armature 31 and the anterior end surface 21*a* of the core 21 make contact, the inner circumference side of the plating layer 30 makes contact with the anterior end surface 21*a* of the core 21.

As shown in FIG. 1, the valve 25 is housed within the valve body 14. When the valve 25 has been housed within the valve body 14, the armature 31 is guided into the inner surface of the ring 20, and the ball 32 is guided into the sliding hole 23*a* of the valve seat 23. As a result, the valve 25 slides in the axial direction of the fuel injector 10 while being guided at two locations: the ring 20 and the valve seat 23.

The adjustor 28 is a cylindrical-shaped member, and has a slit formed therein in the axial direction. The adjustor 28 is pressed into the core 21. A fuel path 28*a* is formed to pass through the adjustor 28 in the axial direction. The spring 26 is inserted in a compressed condition between the adjustor 28 and the armature 31. As a result, the ball 32 of the valve 25 has a biasing force applied by the spring 26, and makes contact with the bowl-shaped part 23*b* of the valve seat 23. In this state, the opening hole 23*c* of the valve seat 23 is closed by the ball 32. When the opening hole 23*c* is closed, the fuel injection hole 24*a* of the plate 24 is also closed. The force that the ball 32 is pressed to the bowl-shaped part 23*b* of the valve seat 23 can be adjusted by means of the position to which the adjustor 28 is inserted.

The solenoid coil 18 is wound directly on an outer circumference of the main body 20*a* of the ring 20. That is, the main body 20*a* of the ring 20 extends towards the posterior from a posterior end of the solenoid coil 18, and the solenoid coil 18 is wound directly on the outer circumference of the main body 20*a*. The method of winding the solenoid coil 18 on the ring 20 can, for example, be a method in which the coil wire of the solenoid coil 18 is wound in sequence around the ring 20. Alternatively, it can be a method in which the coil wire of the solenoid coil 18 has already been wound, and this solenoid coil 18 is mounted on the ring 20.

Further, the solenoid coil 18 can be wound on the ring 20 before the ring 20 and the core 21 are welded, or can be wound after the ring 20 and the core 21 have been welded together. Since the welded part 44*b* is located posterior from the posterior end of the solenoid coil 18, the ring 20 and the core 21 can easily be welded even in the case where the solenoid coil 18 has been wound on the ring 20 before the ring 20 and the core 21 are welded together. Moreover, since the outer diameter of the ring 20 and the outer diameter of the posterior end part of the core 21 are approximately level, it is easy to wind the solenoid coil 18 around the ring 20 even in the case where the solenoid coil 18 is wound on the ring 20 after the ring 20 and the core 21 have been welded. For example, it is possible to attach the solenoid coil 18 to the outer circumference of the ring 20 by inserting the posterior end of the core 21 into a through hole of the solenoid coil 18 in which the coil wire has already been wound, and then moving the solenoid coil 18 in the axial direction.

An insulating film is formed on the coil wire of the solenoid coil 18. As has been described already, an insulating coating is also formed on the surface of the ring 20. Damage to the insulating film on the coil wire of the solenoid coil 18 can thus be prevented. An upper body 46 is disposed at an outer circumference of the solenoid coil 18. The upper body 46 is made from a magnetic material. An anterior end of the upper body 46 is connected with the valve body 14, and a posterior end thereof is connected with the core 21.

A resin part 38 is formed at a posterior end of the ring 20 (at a posterior end of the solenoid coil 18). A power line 39 is disposed within the resin part 38. One end of the power line 39 is connected with the solenoid coil 18, and the other end of the power line 39 is connected with a terminal 37 of a connector 36 provided on the housing 12. Consequently, when power is supplied from the external power source to the terminal 37, power is supplied to the solenoid coil 18 via the power line 39.

As described above, the core 21, the valve body 14, the upper body 46, and the armature 31 are made from magnetic material, and the ring 20 is made from non-magnetic material. As a result, when the solenoid coil 18 is excited, a magnetic path is formed from the upper body 46, the valve body 14, the armature 31, and the core 21. When this magnetic path is formed, the armature 31 is attracted by the magnetic force and the valve 25 retreats toward the core 21 (toward the posterior end) in resistance to the biasing force of the spring 26. When the valve 25 has retreated, the plating layer 30 formed on the posterior end surface 31*a* of the armature 31 makes contact with the anterior end surface 21*a* of the core 21. Moreover, although the distance which the valve 25 slides is short and has therefore not been shown, in the state where the ball 32 of the valve 25 is making contact with the valve seat 23, there is a gap between the plating layer 30 and the anterior end surface 21*a* of the core 21.

The posterior end side of the core 21 protrudes from the housing 12, and a fuel supply port 43 opens into this end part. An O-ring 41 is attached to the part of the core 21 that protrudes from the housing 12. A stopper 42 for preventing the O-ring 41 from falling off is attached further to the posterior than the position where the O-ring 41 is attached. The O-ring 41 ensures a liquidtight state between fuel supply line and the fuel injector 10. The fuel supply line supplies pressurized fuel to the fuel injector 10.

The fuel that has been supplied to the fuel supply port 43 of the core 21 reaches the valve seat 23 by passing sequentially through: the fuel path 22 of the core 21, the fuel path 28*a* of the adjustor 28, the fuel path 33 of the valve 25, and the hole 35 of the valve 25. The opening hole 23*c* is closed by the ball 32 of the valve 25 while this ball 32 is making contact with the bowl-shaped part 23*b* of the valve seat 23. Thereupon fuel does not flow out from the opening hole 23*c*. When the valve 25 retreats, the ball 32 separates from the bowl-shaped part 23*b*, and fuel flows out from the opening hole 23*c*. The fuel that flows out from the opening hole 23*c* is injected to the exterior from the fuel injection hole 24*a* of the plate 24.

In the aforementioned fuel injector 10, the solenoid coil 18 that has power supplied thereto becomes magnetized, whereupon the valve 25 retreats, and fuel is injected from the fuel injection hole 24*a*. The solenoid coil 18 is wound directly on the outer circumference of the ring 20, and consequently there is a shorter distance (i.e., the distance in the radial direction) from the solenoid coil 18 to the armature 31 and the core 21. Further, the posterior end surface 31*a* of the armature 31 (i.e., the surface before plating is performed) and the anterior end surface 21*a* of the core 21 are formed to be approximately parallel, and the plating layer 30 is thinner than in the case where when the roughening process has been performed mechanically. As a result, the armature 31 has a greater attracting force towards the core 21, and the valve 25 can retreat rapidly.

When the power supply is cut off, the valve 25 moves forward and closes the fuel injection hole 24*a*, thus interrupting the injection of the fuel. The plating layer 30 is thicker at the inner circumference side of the armature 31, and therefore the plating layer 30 makes contact with the anterior end surface 21*a* of the core 21 only at this inner circumference side. As a result, fuel will enter between the plating layer 30 and the anterior end surface 21*a* of the core 21 at the outer circumference side of the plating layer 30 even when the plating layer 30 and the core 21 are making contact. The adhesive force is therefore not as strong as when the two surfaces have a wide contacting area. Since the plating layer 30 formed on the armature 31 makes contact with the anterior end surface 21*a* of the core 21 only at the inner circumference side of the armature 31, it is possible to reduce the adhesive force between the armature 31 and the core 21. When this adhesive force is reduced, there is an increase in responsiveness when the fuel injector 10 is to be closed.

As is clear from the above description, in the fuel injector 10 of the present representative embodiment, responsiveness when the valve is to be opened can be increased by increasing the attracting force of the valve 25, and responsiveness when the valve is to be closed can be increased by reducing the adhesive force between the armature 31 and the core 21. As a result, even though the diameter of the fuel injector 10 is decreased, it is possible to suppress a decrease in responsiveness when the valve 25 is to be opened or closed.

Further, the solenoid coil 18 is wound directly on the outer side of the ring 20, and the bobbin that is usually formed on the outer side of the ring can thus be eliminated. Moreover, a clearance between the inner circumference of the solenoid coil 18 and the outer circumference of the ring 20 is no longer required. The diameter of the fuel injector 10 can thus be reduced, and the fuel injector 10 can therefore be made more compact.

In the embodiment described above, the plating layer 30 is thicker at the inner circumference side of the armature 31, and is thinner at the outer circumference side thereof.

Figure 4:
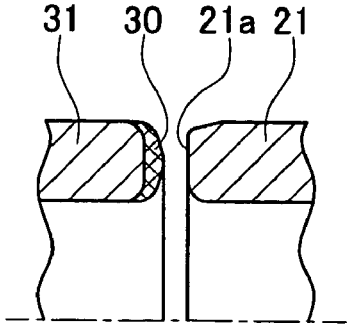
FIG. 4 shows another example of a plating layer formed on the posterior end surface of the armature.
Figure 5:
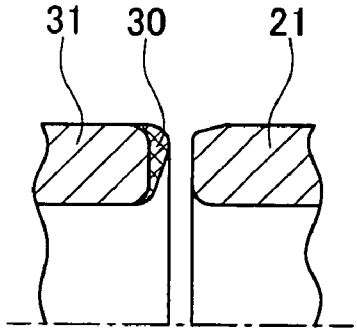
FIG. 5 shows another example of a plating layer formed on the posterior end surface of the armature.
Figure 6:
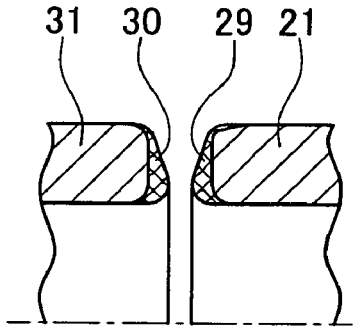
FIG. 6 shows an example in which plating layers have been formed on the posterior end surface of the armature and on an anterior end surface of the core.
Figure 7:
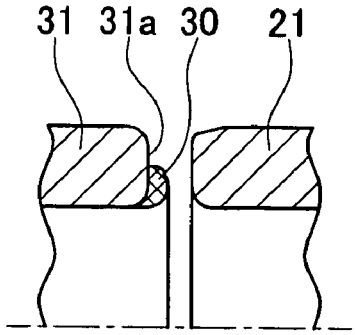
FIG. 7 shows another example of a plating layer formed on the posterior end surface of the armature.
Figure 8:
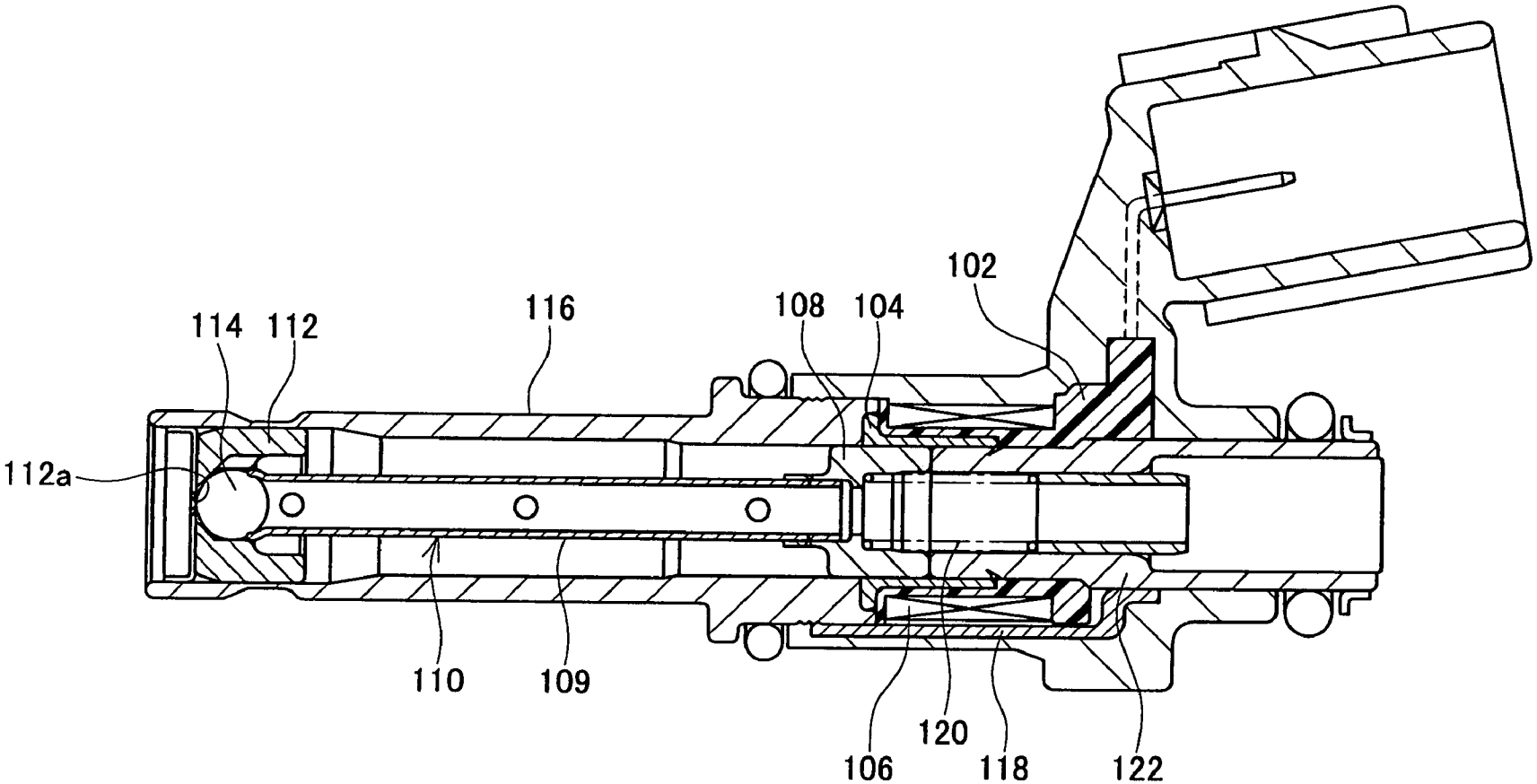
FIG. 8 PRIOR ART
FIG. 8 is a vertical cross-sectional drawing of a conventional fuel injector.

However, the present invention is not restricted to this configuration. For example, as shown in FIG. 4, the plating layer 30 may be thicker at a central location between the inner circumference side and the outer circumference side of the armature 31, and may be thinner at the inner circumference side and the outer circumference side of the armature 31. Further, as shown in FIG. 5, the plating layer 30 may be thinner at the inner circumference side of the armature 31, and may be thicker at the outer circumference side thereof. Further, as shown in FIG. 6, plating layers 30 and 29 may be formed at the ends of the armature 31 and the core 21 respectively. Alternatively, as shown in FIG. 7, the plating layer 30 may be formed on only a part of the posterior end surface 31*a* of the armature 31. That is, the posterior end surface 31*a* of the armature 31 may be partially plated at the any position in a radial direction.

Finally, although the preferred representative embodiments have been described in detail, the present embodiments are for illustrative purpose only and not restrictive. It is to be understood that various changes and modifications may be made without departing from the spirit or scope of the appended claims. In addition, the additional features and aspects disclosed herein also may be utilized singularly or in combination with the above aspects and features.

What is claimed is:

1. A fuel injector comprising:

a core, a valve disposed at a downstream side of the core, the valve having an armature on one end and a hole closing element on the other end, and a solenoid coil for attracting the valve toward the core, wherein an upstream end surface of the armature contacts a downstream end surface of the core when the solenoid coil is excited, wherein the hole closing element closes a fuel injection hole of a valve seat when the solenoid coil is not excited, and wherein at least one of the upstream end surface of the armature and the downstream end surface of the core is plated with a plating layer, the thickness of the plating layer varies in a radial direction, and the upstream end surface of the armature and the downstream end surface of the core are made to be approximately parallel without the plating, and wherein the plating layer is thicker at an inner circumference side.

2. A fuel injector comprising:

a core, a valve disposed at a downstream side of the core, the valve having an armature on one end and a hole closing element on the other end, and a solenoid coil for attracting the valve toward the core, wherein an upstream end surface of the armature contacts a downstream end surface of the core when the solenoid coil is excited, wherein the hole closing element closes a fuel injection hole of a valve seat when the solenoid coil is not excited, and wherein at least one of the upstream end surface of the armature and the downstream end surface of the core is partially plated with a plating layer at any position in a radial direction, and the upstream end surface of the armature and the downstream end surface of the core are made to be approximately parallel without the plating, and wherein the elating layer is thicker at an inner circumference side.

* * * * *